US008277038B2

(12) United States Patent
Baba

(10) Patent No.: US 8,277,038 B2
(45) Date of Patent: Oct. 2, 2012

(54) INK JET PRINTER

(75) Inventor: Ryo Baba, Hamamatsu (JP)

(73) Assignee: Roland DG Corporation, Hamamatsu-shi (JP)

( * ) Notice: Subject to any disclaimer, the term of this patent is extended or adjusted under 35 U.S.C. 154(b) by 211 days.

(21) Appl. No.: 12/793,616

(22) Filed: Jun. 3, 2010

(65) Prior Publication Data

US 2010/0321453 A1 Dec. 23, 2010

(30) Foreign Application Priority Data

Jun. 23, 2009 (JP) ..... 2009-148532

(51) Int. Cl.
*B41J 2/01* (2006.01)

(52) U.S. Cl. ..... 347/102; 347/104

(58) Field of Classification Search ..... None
See application file for complete search history.

(56) References Cited

U.S. PATENT DOCUMENTS 6,893,122 B2 * 5/2005 Shima et al. ..... 347/102
2002/0005870 A1 * 1/2002 Codos et al. ..... 347/9

* cited by examiner

*Primary Examiner* — Stephen Meier
*Assistant Examiner* — Alexander C Witkowski
(74) *Attorney, Agent, or Firm* — Lee, Hong, Degerman, Kang & Waimey

(57) ABSTRACT

An ink jet printer includes: an ink head having a print head for ejecting ink and movable in a first direction, the ink curable upon irradiation with ultraviolet light; a first device positioned on a first side section of the ink head and a second device positioned on a second side section of the ink head opposite the first side section in the first direction, the devices being for irradiating a recording medium with ultraviolet light; and a cutting head attachable to the ink head such that the cutting head is positioned adjacent the ink head, movable in the first direction, and configured to cut at least a portion of the recording medium. When the ink and cutting heads are attached, at least a portion of the cutting head is positioned in front or in rear of one of the devices in a second direction perpendicular to the first direction.

10 Claims, 5 Drawing Sheets

INK JET PRINTER

Pursuant to 35 U.S.C. §119(a), this application claims the benefit of earlier filing date and right of priority to Japanese Patent Application No. 2009-148532, filed on Jun. 23, 2009, the contents of which are hereby incorporated by reference herein in its entirety.

BACKGROUND

1. Field

Embodiments of the present invention relate to an ink jet printer (or ink jet recording apparatus). Particular embodiments relate to an ink jet printer for performing a cutting operation.

2. Discussion of the Related Art

Conventional ink jet printers (or ink jet recording apparatuses) are known. More specifically, a conventional printer ("Printer A") is equipped with an ink head that discharges ink onto a recording medium such as a sheet of recording paper and a cutting head that cuts the recording medium after printing. The cutting head is detachably attached on the left side section of the ink head. When printing is performed by the ink head, the ink head and the cutting head are connected, and the ink head moves with the cutting head along a guide rail in a left-right direction. When cutting the recording medium, the cutting head is separated from the ink head, and independently moves in the left-right direction.

Another type of ink jet printer ("Printer B") is equipped with an ink jet head that ejects ink curable upon irradiation with ultraviolet light (hereafter referred to as "ultraviolet light curable ink") and a pair of ultraviolet light irradiation devices for irradiating the ultraviolet light curable ink that has been discharged on the recording medium with ultraviolet light. The pair of ultraviolet light irradiation devices are attached to left and right side sections of the ink head, and both of the ultraviolet light irradiation devices move in one piece (or together) with the ink head along the guide rail in the left-right direction.

SUMMARY

According to one embodiment, an ink jet printer includes: an ink head having a print head for ejecting ink onto a recording medium, and movable in a first direction, the ink curable upon irradiation with ultraviolet light; a first ultraviolet light irradiation device positioned on a first side section of the ink head and a second ultraviolet light irradiation device positioned on a second side section of the ink head, the second side section located opposite the first side section in the first direction, the ultraviolet light irradiation devices being for irradiating the recording medium with ultraviolet light; and a cutting head attachable to the ink head such that the cutting head is positioned adjacent to the ink head, movable in the first direction, and configured to cut at least a portion of the recording medium. When the ink head and the cutting head are attached to each other, at least a portion of the cutting head is positioned in front or in rear of one of the ultraviolet light irradiation devices in a second direction perpendicular to the first direction.

BRIEF DESCRIPTION OF THE DRAWINGS

The above and other aspects and features of the present disclosure will become more apparent upon consideration of the following description of embodiments, taken in conjunction with the accompanying drawing figures.

DETAILED DESCRIPTION

Figure 1:
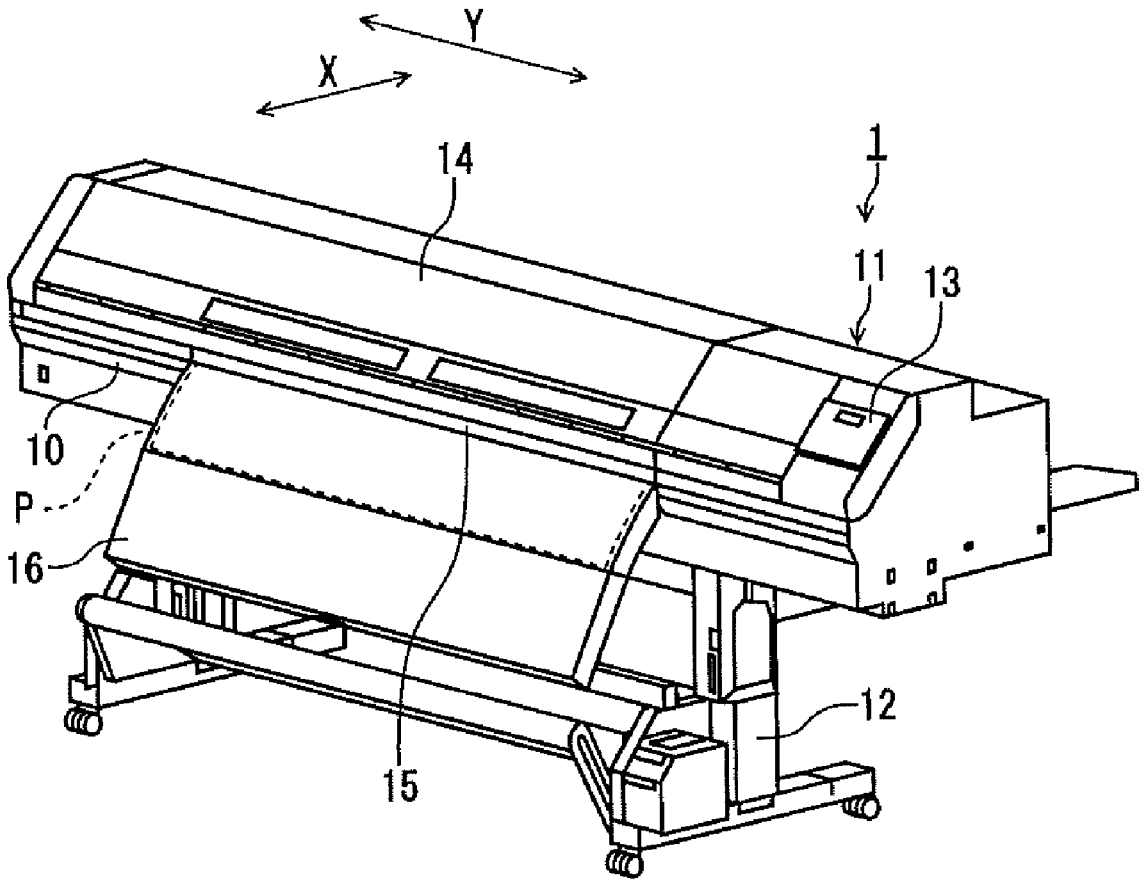
FIG. 1 is a perspective view of an ink jet printer in accordance with an embodiment of the invention.

If the cutting head of Printer A is added to Printer B, it is common to dispose the cutting head on the left side of the ultraviolet light irradiation device on the left side section of the ink head. However, in this configuration, the ink head, the cutting head and the two ultraviolet light irradiation devices are linearly arranged in the left-right direction. This causes the entire length of the printer in the left-right direction to become too long. There has been a tendency in recent years to use a larger ink head to increase the printing speed. However, when the ink head becomes larger in size, the entire length of the printer in the left-right direction (including the ink head, the cutting head and the two ultraviolet light irradiation devices) becomes even longer.

Embodiments of the present invention address such issues, and aspects are directed to provide an ink jet printer (or ink jet recording apparatus) equipped with an ink head, a cutting head and a pair of ultraviolet light irradiation devices, whose overall length is restricted, or at least reduced relative to the printer described in the previous paragraph.

An ink jet printer in accordance with one embodiment includes: an ink head that has a print head that ejects ink (that is curable upon irradiation with ultraviolet light) onto a recording medium and is movable in a left-right direction; a pair of ultraviolet light irradiation devices that are provided on left and right side sections of the ink head and that irradiate the recording medium with ultraviolet light; and a cutting head attachable to the ink head in a manner such that it is positioned to the side of the ink head, movable in the left-right direction, and cuts at least a portion of the recording medium, wherein, when the ink head and the cutting head are attached to each other, at least a portion of the cutting head is positioned in front or in rear of one of the ultraviolet light irradiation devices.

In accordance with embodiments of the invention, it is possible to provide an ink jet printer that is equipped with an ink head, a cutting head and a pair of ultraviolet light irradiation devices, the overall length of which is restricted (or at least reduced).

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

According to one embodiment, an ink jet printer (e.g., ink jet printer 1 of FIG. 1) is used for printing on a sheet of recording paper P that is a recording medium.

It is appreciated that the "recording medium" may include not only a recording medium made of paper such as ordinary paper, but also other recording media made of various kinds of materials including resin materials such as PVC, polyester and the like, metal such as aluminum, iron and the like, and wood material(s) and the like. Also, certain embodiments of the invention employ a printing method using ink jet technology. It is appreciated that embodiments may include a variety of known printing methods, and include, for example, various types of continuous methods including a binary valued deflection method, a continuous deflection method or the like, various types of on-demand methods including a thermal method, a piezoelectric element method or the like.

With reference to FIG. 1, an ink jet printer 1 is shown. The ink jet printer 1 is equipped with an ink head 2, a cutting head 3 and a pair of ultraviolet light irradiation devices 4*a* and 4*b* (see FIG. 2). The ink head 2 ejects ultraviolet light curable ink onto a recording paper P. The ultraviolet light irradiation devices 4*a* and 4*b* irradiate ultraviolet light curable ink discharged on the recording paper P with ultraviolet light, thereby curing the ultraviolet light curable ink. The cutting head 3 performs a cutting of the recording paper P. It is noted that an arrow Y shown in FIG. 1 indicates a primary scanning direction, and an arrow X indicates an auxiliary scanning direction that is a direction orthogonal to the primary scanning direction Y.

The ink jet printer 1 is equipped with a main body 11 having a casing 10 that extends along the primary scanning direction Y, and legs 12 that support the main body 11. An operation panel 13 is provided on the right side of the main body 11.

The operation panel 13 is provided with a display section that displays operation states, a cursor key for designating the positions of the ink head 2 and the cutting head 3, a start region setting key for designating a region of a specified portion for which printing or cutting is to be started based on an image data signal, an operation start key for starting printing or cutting from the designated start region, and the like.

A front cover 14 that can be freely opened and closed is mounted on an upper portion of the main body 11. A discharge port 15 for discharging the recording paper P is formed in the main body 11 on its lower side. A guide 16 is provided at a position at the (or in) front of and below the discharge port 15 for guiding the recording paper P that is discharged from the discharge port 15 in a forwardly diagonal downward direction.

Figure 2:
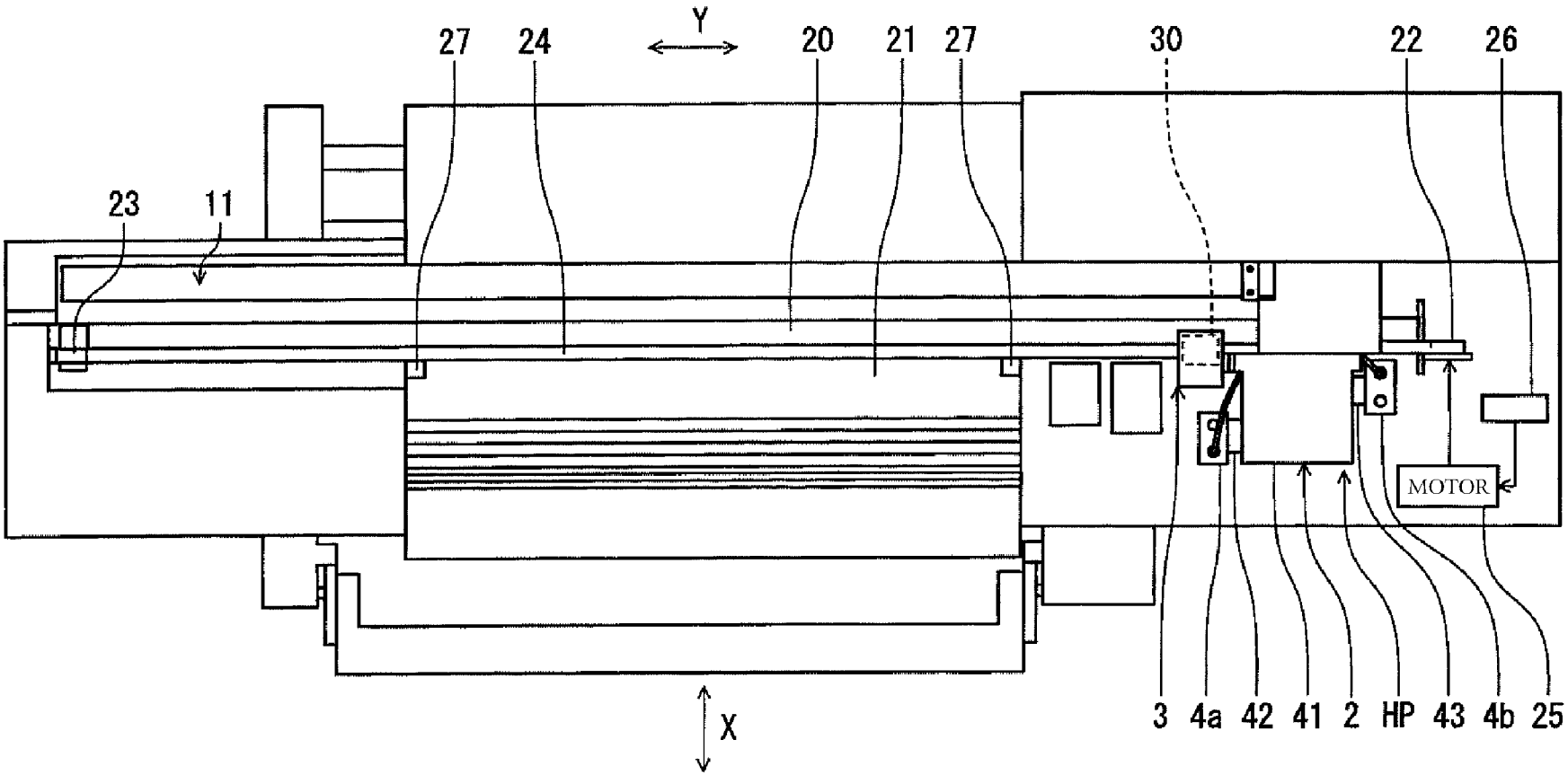
FIG. 2 is a plan view showing the internal structure of an ink jet printer according to one embodiment.

Next, the internal structure of the main body 11 will be described according to one embodiment. As shown in FIG. 2, a guide rail 20 extending in the primary scanning direction Y is provided inside the main body 11. It is noted that, with reference to the plan view of the ink jet printer 1 as shown in FIG. 2, the primary scanning direction Y corresponds to a left-right direction, and the auxiliary scanning direction X corresponds to a front-rear direction. In this respect, the primary scanning direction Y may be referred to as the left-right direction, and the auxiliary scanning direction X may be referred to as the front-rear direction. A platen 21 is disposed in a central area and in front of the guide rail 20. The platen 21 is a part for supporting the recording paper P during printing by the ink head 2 and during cutting of the recording paper P by the cutting head 3. Printing and cutting of the recording paper P are conducted on the platen 21.

A pulley 22 is provided adjacent to the right end section of the guide rail 20, and a pulley 23 is provided adjacent to the left end section of the guide rail 20. An endless belt 24 is wound around the pulleys 22 and 23. A motor 25 is coupled to the pulley 22. When the motor 25 drives the pulley 22, the belt 24 is driven between the pulleys 21 and 22. A control device 26 is communicably connected to the motor 25. The motor 25 is a motor that can be freely rotated in forward and reverse directions. The control device 26 controls the motor 25, thereby controlling movements of a carriage 30 to be described below. It is noted that, in accordance with the present embodiment, the pulley 22 is driven, but it is understood that the pulley 23 may be driven instead.

Figure 3:
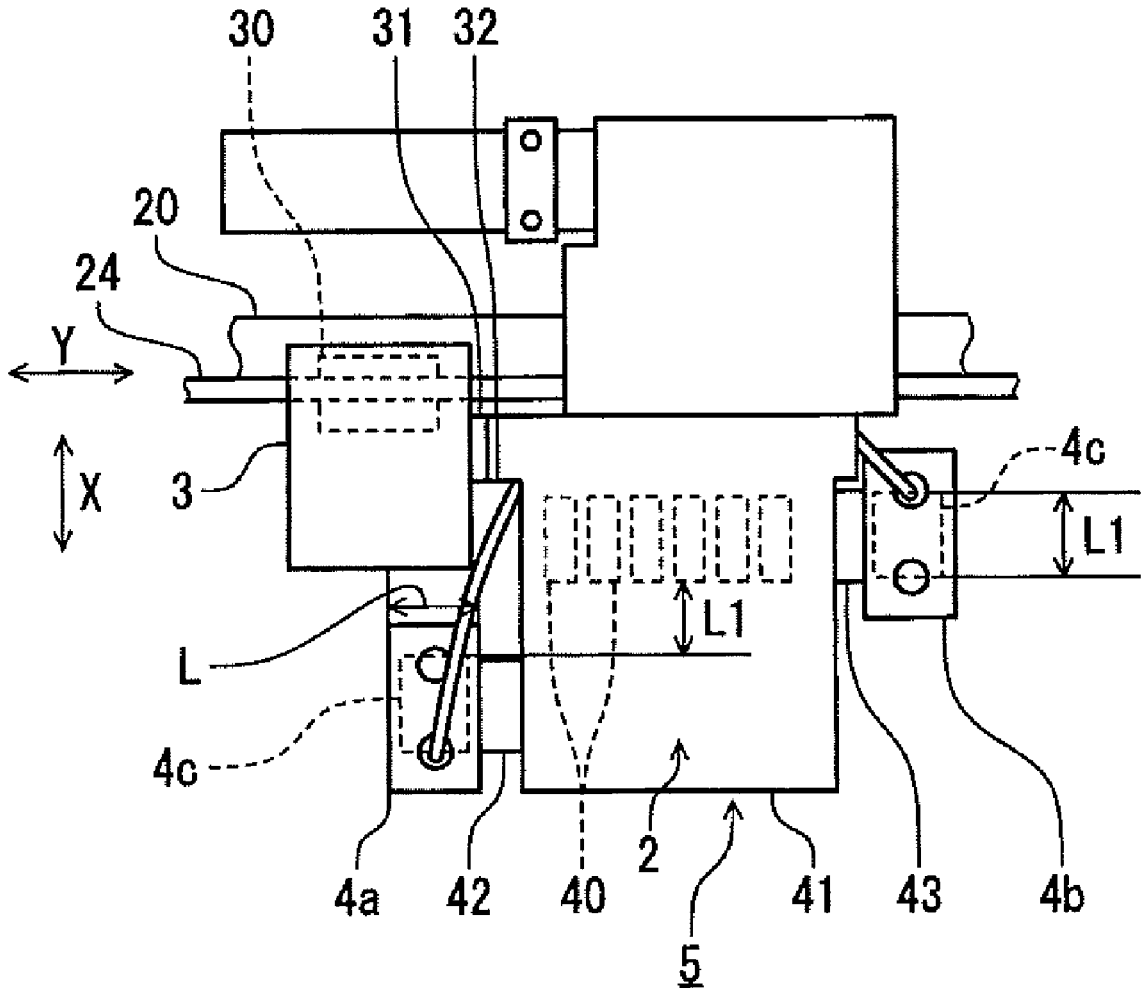
FIG. 3 is a plan view showing an ink head and a cutting head according to one embodiment.

A carriage 30 built in the cutting head 3 is attached to the belt 24. The carriage 30 engages with the guide rail 20. For this reason, the cutting head 3 moves with the carriage 30 in the left-right direction as the belt 24 is driven. As shown in FIG. 3, a magnet 31 is attached to a right side section of the cutting head 3. In accordance with one embodiment, the magnet 31 is disposed generally in the central portion of the cutting head 3 in the front-rear direction.

As shown in FIG. 2, a pair of upper and lower rollers 27 is provided at each of the left end section and the right end section of the platen 21 for feeding the recording paper P in the auxiliary scanning direction X. It is noted that FIG. 2 illustrates only the upper rollers 27. Among the pair of upper and lower rollers 27, one of the rollers 27 is a driving roller that rotates itself, and the other of the rollers 27 is a pinching roller for pinching the recording paper P with the driving roller. It is noted that the operation of the driving rollers is controlled by the control device 26. These rollers 27 form a transfer mechanism that transfers the recording paper P in the auxiliary scanning direction X. It is noted that the positions of the pair of upper and lower rollers 27 may not be limited, in particular, to the left end section and the right end section of the platen 21.

Next, the ink head 2 is described. The ink head 2 is a head that ejects ink toward the recording paper P. As shown in FIG. 3, the ink head 2 has a plurality of print heads 40 each having nozzles for ejecting ink, and a print head carriage 41 that supports these print heads 40. The print head carriage 41 engages with the guide rail 20 in a manner freely moveable in the left-right direction. The print heads 40 eject ink droplets downward from the nozzles. An ink cartridge filled with ink is attached to the rear portion of the main body 11. The print heads 40 are connected to the ink cartridge through tubes or the like. Ink is supplied to the print heads 40 from the ink cartridge described above. It is noted that the ejection operation of the ink head 2 is also controlled by the control device 26.

According to one embodiment, the ink ejected from the nozzles of the ink head 2 is ultraviolet light curable ink. According to one embodiment, the ultraviolet light irradiation devices 4*a* and 4*b* are composed of ultraviolet light emitting diodes. It is noted that the ultraviolet light irradiation devices 4*a* and 4*b* may be composed of, for example, halogen lamps or the like. One of the ultraviolet light irradiation devices (e.g., device 4*a*) is attached to the left side section of the print head carriage 41 through a coupling member 42. The other of the ultraviolet light irradiation devices (e.g., device 4*b*) is attached to the right side section of the print head carriage 41 through a coupling member 43. According to one embodiment, the ultraviolet light irradiation device 4*a* and the other ultraviolet light irradiation device 4*b* are disposed at positions mutually shifted (or offset from each other) in the front-rear direction. The ultraviolet light irradiation device 4*a* is disposed in front of the other ultraviolet light irradiation device 4*b*. As shown in FIG. 3, a magnet 32 is attached to the left side section of the print head carriage 41 in its rear side.

Each of the ultraviolet light irradiation devices 4*a* and 4*b* has a lamp 4*c* that is a light emitting section. In accordance with one embodiment, the length L1 of the lamp 4*c* in the front-rear direction is equal to the length of the print head 40 in the front-rear direction (see, e.g., FIG. 3). The rear end edge of the lamp 4*c* of the ultraviolet light irradiation device 4*a* is located in front of the front end edge of the print head 40 by the length L1. According to one embodiment, the front end edge and the rear end edge of the lamp 4*c* of the ultraviolet light irradiation device 4*b* match (or align) with the front end edge and the rear end edge of the print head 40, respectively. However, they may not necessarily match with one another. For example, the length of the lamp 4*c* in the front-rear direction may be made longer than the length of the print head 40 in the front-rear direction, and the front end edge of the lamp 4*c* may be disposed in front of the front end edge of the print head 40, or the rear end edge of the lamp 4*c* may be disposed in rear of the rear end edge of the print head 40. Further, according to one embodiment, the rear end edge of the lamp 4*c* of the ultraviolet light irradiation device 4*a* is disposed in front of the front end edge of the print head 40 by a distance equal to the length L1 of the print head 40 in the front-rear direction. However, it is not necessary to do so. For example, the rear end edge of the lamp 4*c* may be matched with the front end edge of the print head 40.

Figure 4:
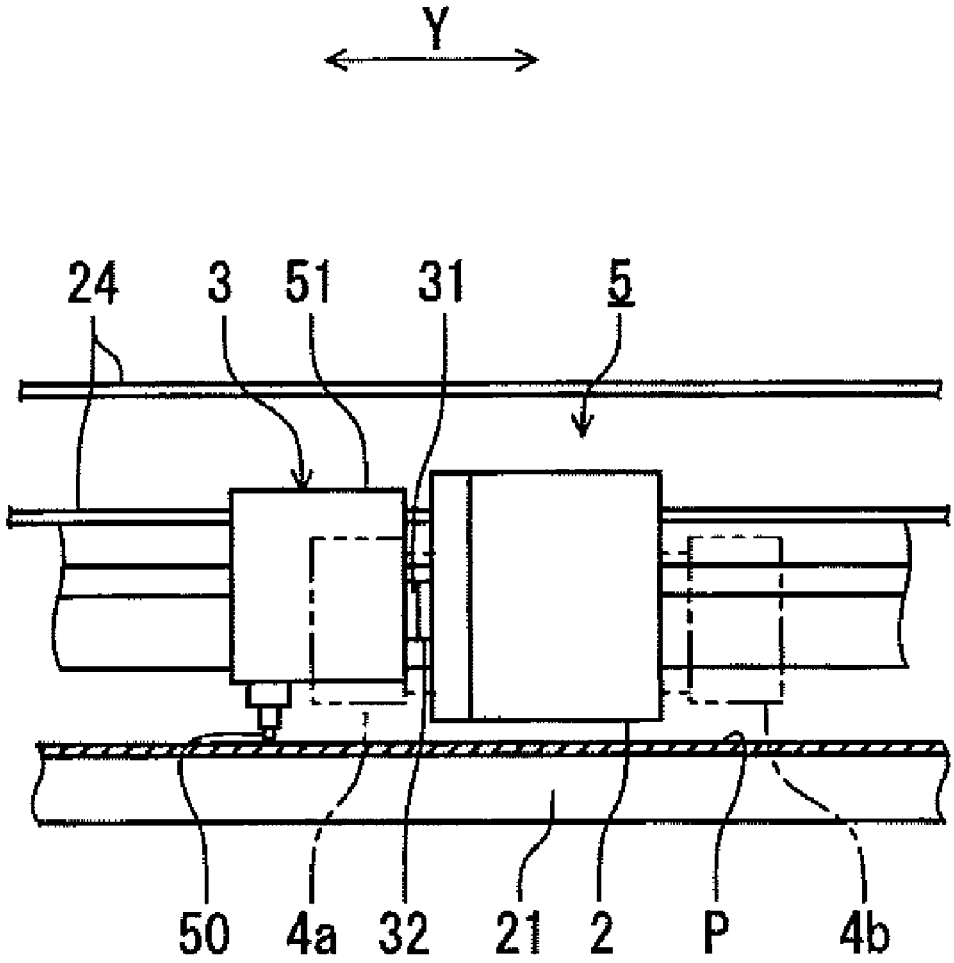
FIG. 4 is a front view showing a state in which a recording medium is cut by the cutting head according to one embodiment.

Next, the cutting head 3 is described. The cutting head 3 is a head for cutting the recording paper P. During cutting of the recording paper P, the cutting head 3 is moved in the primary scanning direction Y by the carriage 30, and the recording paper P is moved in the auxiliary scanning direction X by the rollers 27. As a result, the cutting head 3 can be moved to cut the recording paper P in a two-dimensional manner, and a designated portion of the recording paper P can be cut or cut out. As shown in FIG. 4, the cutting head 3 is equipped with a case 51 that supports a cutter 50. The cutting head 3 contains the carriage 30 (see FIG. 2). It is noted that the ultraviolet light irradiation devices 4*a* and 4*b* are illustrated using phantom lines in FIG. 4.

As the magnet 31 provided on the right side section of the case 51 contacts the magnet 32 of the ink head 2, these magnets 31 and 32 are attracted to each other, and the cutting head 3 and the ink head 2 are coupled to each other. As a result, the cutting head 3 and a head 5 with the ink head 2 and the ultraviolet light irradiation devices 4*a* and 4*b* are connected as one piece. Conversely, when the belt 24 is driven to a state in which the ink head 2 is at a fixed position, and a leftward force is applied to the cutting head 3 through the carriage 30, the two magnets 31 and 32 are separated from each other. In other words, when the cutting head 3 moves to the left while the ink head 2 is fixed at a home position HP to be described below (see FIG. 2), the connection between the cutting head 3 and the ink head 2 is severed. In this manner, the magnets 31 and 32 may freely detachably connect the cutting head 3 and the ink head 2.

Next, operations of the ink jet printer 1 are described. As described above, the ink jet printer 1 is capable of printing with the ink head 2, curing ink with the ultraviolet light irradiation devices 4*a* and 4*b*, and cutting with the cutting head 3.

Figure 5:
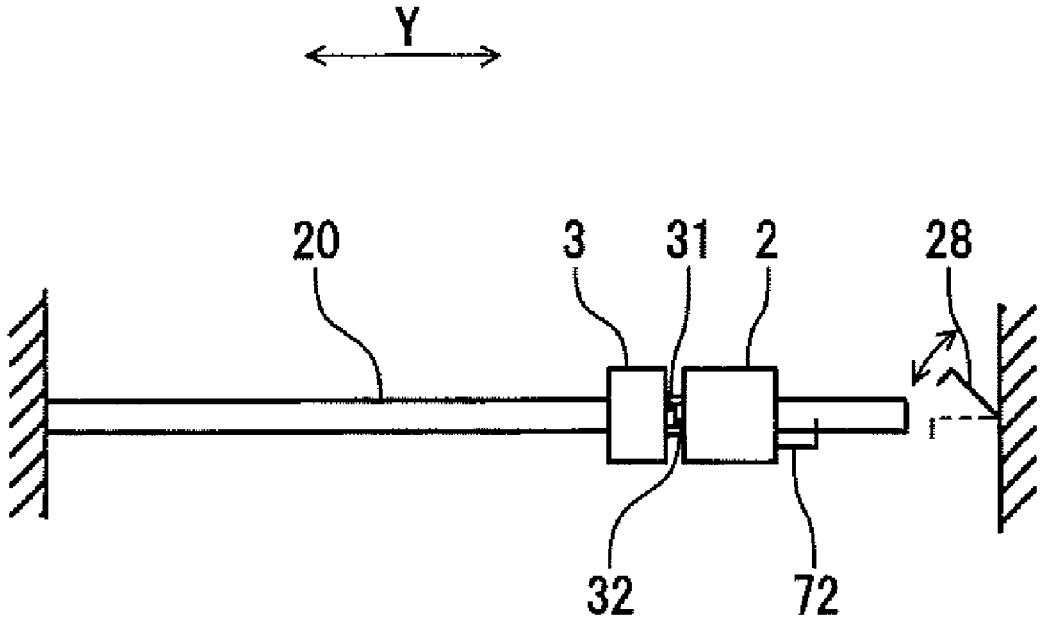
FIG. 5 is a front view illustrating a coupling between the ink head and the cutting head according to one embodiment.

During printing, the ink head 2 is connected to the cutting head 3. The connection of these heads occurs at the home position HP. When the cutting head 3 moves to the right along the guide rail 20 while the ink head 2 is on standby at the home position HP, the magnet 31 on the ink head 2 eventually comes in contact with the magnet 32 on the ink head 2, and the cutting head 3 and the ink head 2 are connected to each other by the magnets 31 and 32. As schematically shown in FIG. 5, a latch member 72 is provided on the ink head 2, and a latch member 28 that is detachably engageable with the latch member 72 on the ink head 2 is provided on the right end section of the main body 11. (Upon completion of a cutting operation, the latch member 28 transitions from an engaged state (a state shown by a phantom line in FIG. 5) to a non-engaged state (a state shown by a solid line in FIG. 5), and the engagement between the latch member 72 on the ink head 2 and the latch member 28 on the main body 11 is severed.) Therefore, as the cutting head 3 moves in the primary scanning direction Y, the ink head 2 moves together with the cutting head 3 in the primary scanning direction Y.

Printing is started after the ink head 2 positioned at the home position HP has been connected to the cutting head 3. It is noted that the home position HP of the ink head 2 is not limited to the right end section of the main body 11. For example, according to an alternative embodiment, the home position HP may be disposed at a left end section within the main body 11. In this case, for example, the other ultraviolet light irradiation device 4*b* may be disposed on the right side section of the ink head 2 and in front of the ink head 2, and the cutting head 3 may be disposed to the rear of the ultraviolet light irradiation device 4*b*.

While reciprocally moving in the primary scanning direction Y, the ink head 2 ejects ink droplets toward the recording paper P. The ink head 2 may eject ink droplets only when moving in the left direction (in a single directional printing), or may eject ink droplets while moving in the left direction and while moving in the right direction (in a bi-directional printing). The recording paper P is transferred in the auxiliary scanning direction X by the rollers 27, while the ink head 2 is reciprocally moved. For example, as the ink head 2 moves from a first side to the other side of the primary scanning direction Y, the recording paper P is transferred forward by a predetermined length. Then, when the ink head 2 reverses direction and moves from the other side to the first side, the recording paper P is transferred forward again by a predetermined length, and similar operations are repeated. As such, a two-dimensional image or the like is formed on the recording paper P. Also, in coordination with the movements of the ink head 2 in the primary scanning direction Y, the ultraviolet light irradiation devices 4*a* and 4*b* are appropriately lit. By this operation, the ink droplets discharged on the recording paper P are irradiated with ultraviolet light. As a result, the ink droplets on the recording paper P are cured, and fixed on the recording paper P.

During a cutting operation, the ink head 2 is on standby at the home position HP (see FIG. 2) in a state in which it is separated from the cutting head 3. Upon completion of printing, the ink head 2 is transferred to the home position HP by the cutting head 3. Then, as the ink head 2 arrives at the home position HP, the latch member 28 shifts from the non-engaged state to the engaged state, thereby engaging with the latch member 72 on the ink head 2. As the cutting head 3 then moves to the left, the cutting head 3 is separated from the ink head 2, overcoming the attractive force between the magnet 31 on the cutting head 3 and the magnet 32 on the ink head 2. As such, the ink head 2 remains at the home position HP, and is placed on standby at the home position HP.

When the cutting head 3 moves to a predetermined position in the recording paper P, the cutter 50 of the cutting head 3 (see FIG. 4) lowers, and cuts into the recording paper P. Then, while the cutter 50 continues to cut into the recording paper P, the cutting head 3 moves in the primary scanning direction Y, and the recording paper P is transferred by the rollers 27 in the auxiliary scanning direction X. As such, the recording paper P is cut out in a predetermined shape.

As described above with reference to various embodiments (e.g., the ink jet printer 1 of FIG. 1), the ultraviolet light irradiation device 4*a* is disposed at a side of the ink head 2 toward the front side of the ink head 2, such that a space is formed at the rear of the ultraviolet light irradiation device 4*a*.

As shown in FIG. 3, when the cutting head 3 is connected with the ink head 2, the cutting head 3 can be disposed in the space, thereby effectively utilizing the space.

Also, the cutting head 3 arranged in this manner has a portion having a length L which overlaps the ultraviolet light irradiation device 4*a* in the front-rear direction. Therefore, in the left-right direction, the length of the head 5 that is composed of the ink head 2, the cutting head 3 and the ultraviolet light irradiation devices 4*a* and 4*b* can be shortened. As such, the ink jet printer 1 can be made smaller in size. Accordingly, in embodiments of the invention, it is possible to use an ink head 2 equipped with multiple print heads 40 such that the printing speed can be increased, and printing with excellent image quality can be obtained.

Furthermore, the ultraviolet light irradiation device 4*a* and the ultraviolet light irradiation device 4*b* are disposed at positions mutually offset from each other in the front-rear direction, such that the state of ultraviolet light irradiation by each of the ultraviolet light irradiation devices 4*a* and 4*b* can be appropriately changed. This makes it possible to perform a variety of printings including a printed surface with a smooth surface, and the like.

Also, the ultraviolet light irradiation device 4*b* is disposed in rear of the ultraviolet light irradiation device 4*a*, and is disposed at the right side section of the (rightmost) print head 40 provided on the ink head 2 (see FIG. 3). Accordingly, in a single directional printing, in which printing is performed only when the ink head 2 moves in the left direction, in other words, only in one direction, ultraviolet light can be irradiated by the ultraviolet light irradiation device 4*b* immediately after ink has been discharged onto the recording paper P. Therefore, the ink jet printer 1 can be made smaller in size, and excellent print quality can be obtained by curing ink immediately after having been ejected from the print head 40.

In embodiments described above, one of the ultraviolet light irradiation devices (e.g., device 4*a*) and the other of the ultraviolet light irradiation devices (e.g., device 4*b*) are arranged at positions shifted (or offset) from each other in the front-rear direction. However, embodiments of the present invention are not limited to this arrangement. For example, it is possible to arrange the two ultraviolet light irradiation devices 4*a* and 4*b* on a common line so as to be left-right symmetrical.

Also, the attaching and detaching mechanism for the ink head 2 and the cutting head 3 is not limited to that achieved by the magnets 31 and 32 described earlier. For example, it is appreciated that a mechanical hook system may also be suitable.

Also, in various embodiments, the cutting head 3 is configured to be self-driven by the carriage 30 built therein. However, embodiments of the present invention are not limited to such a configuration, and an independent carriage may be provided to move the cutting head 3 in the left-right direction. Also, the carriage may be built in the ink head 2.

The "cutting" operation, as performed by the cutting head, includes not only cutting a recording medium through its entire thickness, but also cutting only a portion thereof (e.g., a layer at its surface).

In addition to the above, it is appreciated that the scope of this disclosure spans various variations in the design of the ink jet printer 1, such as, the composition of each of the components, the configuration and the like.

The foregoing embodiments and advantages are merely exemplary and are not to be construed as limiting the present invention. The present teaching can be readily applied to other types of apparatuses and processes. The description of embodiments of the present invention is intended to be illustrative, and not to limit the scope of the claims. Many alternatives, modifications, and variations will be apparent to those skilled in the art.

What is claimed is:

1. An ink jet printer comprising:

an ink head having a print head for ejecting ink onto a recording medium, and movable in a first direction along a guide rail, the ink curable upon irradiation with ultraviolet light;

a first ultraviolet light irradiation device positioned on a first side section of the ink head and a second ultraviolet light irradiation device positioned on a second side section of the ink head, the second side section located opposite the first side section in the first direction, the ultraviolet light irradiation devices being for irradiating the recording medium with ultraviolet light; and a cutting head attachable to the ink head such that the cutting head is positioned adjacent to the ink head between the guide rail and at most one of the ultraviolet light irradiation devices in a second direction perpendicular to the first direction, movable in the first direction along the guide rail, and configured to cut at least a portion of the recording medium, wherein, when the ink head and the cutting head are attached to each other, at least a portion of the cutting head is positioned in front or in rear of the at most one of the ultraviolet light irradiation devices in the second direction.

2. The ink jet printer recited in claim 1, wherein the ultraviolet light irradiation devices are disposed at positions offset from each other in the second direction.

3. The ink jet printer recited in claim 2, wherein the first ultraviolet light irradiation device is disposed in front of the second ultraviolet light irradiation device in the second direction, the second ultraviolet light irradiation device is positioned to the left or the right of the print head in the first direction, and the print head ejects the ink at least when the ink head moves to be led by the first side section where the first ultraviolet light irradiation device is located.

4. The ink jet printer recited in claim 1, further comprising a carriage for moving the cutting head in the first direction.

5. The ink jet printer recited in claim 4, wherein the carriage is integral with the cutting head.

6. The ink jet printer recited in claim 1, wherein, when the ink head and the cutting head are attached to each other, the at least a portion of the cutting head is positioned in rear of the at most one of the ultraviolet light irradiation devices in the second direction, wherein the at most one of the ultraviolet light irradiation devices is the first ultraviolet light irradiation device.

7. The ink jet printer recited in claim 6, wherein the second ultraviolet light irradiation device comprises a light emitting member.

8. The ink jet printer recited in claim 7, wherein the light emitting member has a length along a dimension extending in the second direction, the length of the light emitting member being equal to a length of the print head along the dimension.

9. The ink jet printer recited in claim 8, wherein, in the second direction, the first ultraviolet light irradiation device and the print head are spaced apart from each other by a distance approximately equal to the length of the print head.

10. The ink jet printer recited in claim 1, wherein the cutting head comprises a cutter movable in the second direction to cut into the recording medium.

* * * * *